US010974529B2

(12) United States Patent
Leibezeder et al.

(10) Patent No.: US 10,974,529 B2
(45) Date of Patent: Apr. 13, 2021

(54) DRIVE UNIT FOR A BAND GEAR IN AN IMPRESSION UNIT FOR A STAMP

(71) Applicant: Trodat GmbH, Wels (AT)

(72) Inventors: Reinhard Leibezeder, Saleinsbach (AT); Konrad Riegler, Eberstalzell (AT); Helmut Lindner, Peuerbach (AT)

(73) Assignee: Trodat GmbH, Wels (AT)

( * ) Notice: Subject to any disclaimer, the term of this patent is extended or adjusted under 35 U.S.C. 154(b) by 135 days.

(21) Appl. No.: 16/307,734

(22) PCT Filed: Jun. 7, 2017

(86) PCT No.: PCT/AT2017/060146

§ 371 (c)(1),
(2) Date: Dec. 6, 2018

(87) PCT Pub. No.: WO2017/210711

PCT Pub. Date: Dec. 14, 2017

(65) Prior Publication Data

US 2019/0299690 A1 Oct. 3, 2019

(30) Foreign Application Priority Data

Jun. 9, 2016 (AT) ..... 50527/2016

(51) Int. Cl.
*B41K 1/10* (2006.01)
*B41K 1/36* (2006.01)
*B41K 1/40* (2006.01)

(52) U.S. Cl.
CPC . *B41K 1/10* (2013.01); *B41K 1/40* (2013.01)

(58) Field of Classification Search
CPC ..... B41K 1/10; B41K 1/40; B41K 1/36
(Continued)

(56) References Cited

U.S. PATENT DOCUMENTS 454,499 A 6/1891 Ryer
973,556 A 10/1910 Peterson
(Continued)

FOREIGN PATENT DOCUMENTS

AT 501318 11/2006
AT A50017/2014 1/2014
(Continued)

OTHER PUBLICATIONS

Advisory Action for U.S. Appl. No. 29/567,666 dated May 29, 2018.

(Continued)

*Primary Examiner* — Leslie J Evanisko
(74) *Attorney, Agent, or Firm* — Kowert, Hood, Munyon, Rankin & Goetzel, P.C.; Garet M. Sampson

(57) ABSTRACT

In some embodiments, a system includes a stamp, a band gear, a bridge, a driver, and a drive unit, in particular an ABU, preferably for a band gear in an impression unit for a stamp (1). The system includes at least an adjustment wheel with a driver, and a so-called bridge. A band is fastened over the driver and around the bridge. When the adjustment wheel is actuated, the band is adjusted via the driver. The driver of the band gear is formed from at least two different materials, in particular a 2C injection-moulded component. The outer component butting against the band or conveyor band, respectively, has a low thickness preferably of less than 1.5 mm, in particular 0.4 to 0.8 mm.

12 Claims, 5 Drawing Sheets

(58) Field of Classification Search
USPC ..... 101/106, 108, 327–333, 105, 111
See application file for complete search history.

(56) References Cited

U.S. PATENT DOCUMENTS

| | | | |
|---|---|---|---|
| D331,418 | S | 12/1992 | Winston |
| D359,504 | S | 6/1995 | Stefanski |
| D367,879 | S | 3/1996 | Smith |
| D387,800 | S | 12/1997 | Daw |
| 5,694,844 | A | 12/1997 | Taira |
| D389,175 | S | 1/1998 | Imamaki |
| 5,727,467 | A | 3/1998 | Skopek |
| 5,768,992 | A | 6/1998 | Daw et al. |
| D400,566 | S | 11/1998 | Schreiberhuber |
| 5,850,787 | A | 12/1998 | Daw |
| 5,971,130 | A | 10/1999 | Nakamura |
| D417,464 | S | 12/1999 | Skopek |
| 6,067,905 | A | 5/2000 | Faber |
| D451,944 | S | 12/2001 | Lipkin |
| 6,732,649 | B1 | 5/2004 | Wall et al. |
| 6,813,999 | B2 | 11/2004 | Treml |
| 6,834,584 | B1 | 12/2004 | MacNeil |
| 6,892,638 | B2 | 5/2005 | Sculler |
| 7,069,852 | B2 | 7/2006 | Zindl |
| D538,328 | S | 3/2007 | Faber |
| D540,848 | S | 4/2007 | Faber |
| D542,335 | S | 5/2007 | Faber |
| D542,835 | S | 5/2007 | Faber |
| 7,389,727 | B2 | 6/2008 | Faber |
| D588,187 | S | 3/2009 | Shih |
| 7,520,221 | B2 | 4/2009 | Ameshofer |
| D618,274 | S | 6/2010 | Faber |
| 7,743,703 | B2 | 6/2010 | Ameshofer |
| 7,853,353 | B1 | 12/2010 | Hagen et al. |
| 7,877,909 | B1 | 2/2011 | Hagen et al. |
| 7,894,935 | B1 | 2/2011 | Hagen et al. |
| D645,121 | S | 9/2011 | Fukasawa |
| 8,050,796 | B1 | 11/2011 | Hagen et al. |
| D668,714 | S | 10/2012 | Zindl |
| D677,322 | S | 3/2013 | Zindl |
| 8,402,890 | B2 | 3/2013 | Faber |
| 8,408,126 | B2 | 4/2013 | Faber |
| 8,413,357 | B1 | 4/2013 | Hagen et al. |
| 9,227,450 | B2 | 1/2016 | Faber |
| 9,333,784 | B2 | 5/2016 | Faber et al. |
| 9,354,630 | B2 | 5/2016 | Sukhman |
| 9,475,326 | B2 | 10/2016 | Petersen |
| 9,735,561 | B2 | 8/2017 | Schwarz et al. |
| D803,307 | S | 11/2017 | Riegler et al. |
| 9,895,919 | B2 | 2/2018 | Zehetner et al. |
| D820,350 | S | 6/2018 | Riegler et al. |
| D823,378 | S | 7/2018 | Riegler et al. |
| D847,899 | S | 5/2019 | Riegler et al. |
| 10,456,868 | B2 | 10/2019 | Pinot et al. |
| 2001/0049669 | A1 | 12/2001 | Ito et al. |
| 2003/0150343 | A1 | 8/2003 | Koneczny |
| 2005/0066828 | A1 | 3/2005 | Wei |
| 2006/0000374 | A1 | 1/2006 | Faber |
| 2006/0000376 | A1 | 1/2006 | Faber et al. |
| 2006/0162596 | A1 | 7/2006 | Faber |
| 2006/0185539 | A1 | 8/2006 | Faber |
| 2007/0272099 | A1 | 11/2007 | Pointl |
| 2008/0087180 | A1 | 4/2008 | Ameshofer |
| 2009/0255427 | A1 | 10/2009 | Faber |
| 2009/0301327 | A1 | 12/2009 | Nelson |
| 2010/0031835 | A1 | 2/2010 | Faber |
| 2010/0263561 | A1 | 10/2010 | Faber |
| 2011/0277647 | A1 | 11/2011 | Zindl |
| 2011/0313561 | A1 | 12/2011 | Lee |
| 2013/0291744 | A1 | 11/2013 | Anthony |
| 2015/0181033 | A1 | 6/2015 | Keller |
| 2016/0325381 | A1 | 11/2016 | Pinot et al. |
| 2016/0361934 | A1 | 12/2016 | Riegler et al. |
| 2016/0361935 | A1 | 12/2016 | Sillipp et al. |
| 2016/0361936 | A1 | 12/2016 | Zehetner et al. |
| 2016/0368297 | A1 | 12/2016 | Scharinger et al. |
| 2019/0299690 | A1 | 10/2019 | Leibezeder et al. |

FOREIGN PATENT DOCUMENTS

| | | | |
|---|---|---|---|
| AT | A50473/2015 | | 6/2015 |
| AT | A50474/2015 | | 6/2015 |
| AT | A50475/2015 | | 6/2015 |
| AT | A50478/2015 | | 6/2015 |
| CA | 2717256 | | 11/2011 |
| CN | 301153224 | | 3/2010 |
| CN | 304057436 | | 2/2017 |
| CN | 304057437 | | 2/2017 |
| DE | 1654769 | | 4/1953 |
| DE | 202010007577 | U | 8/2010 |
| DE | 102014210611 | | 12/2015 |
| EM | 001922865-0001 | | 2/2012 |
| EM | 002716431-0001 | | 1/2017 |
| EM | 002716431-0011 | | 1/2017 |
| EM | 002904854-0007 | | 1/2017 |
| EP | 0459969 | | 12/1991 |
| EP | 0804344 | B1 | 9/1998 |
| EP | 2384283 | B1 | 11/2011 |
| EP | 2591921 | B1 | 5/2013 |
| EP | 2594406 | | 5/2013 |
| JP | 2008042032 | | 2/2008 |
| JP | D1546014 | | 3/2016 |
| WO | 1999064246 | | 12/1999 |
| WO | 2004085110 | | 10/2004 |
| WO | 2006029422 | | 3/2006 |
| WO | 2006079129 | | 8/2006 |
| WO | 2006079131 | | 8/2006 |
| WO | 2010085828 | | 8/2010 |
| WO | 2011056345 | | 5/2011 |
| WO | 2011151604 | | 12/2011 |
| WO | 2014113833 | | 7/2014 |
| WO | 2014/172738 | A1 | 10/2014 |
| WO | 2014172738 | | 10/2014 |
| WO | 2015103654 | | 7/2015 |
| WO | 2015176089 | | 11/2015 |
| WO | 2016/197172 | | 12/2016 |
| WO | 2016197170 | | 12/2016 |
| WO | 2016197171 | | 12/2016 |
| WO | 2016197173 | | 12/2016 |
| WO | 2017210711 | | 12/2017 |
| WO | 2018064692 | | 4/2018 |

OTHER PUBLICATIONS

Non Final Office Action for U.S. Appl. No. 15/177,072 dated Apr. 6, 2018.

Non Final Office Action for U.S. Appl. No. 15/177,078 dated Jun. 14, 2018.

Notice of Allowance for U.S. Appl. No. 29/548,144 dated Mar. 19, 2018.

Notice of Allowance for U.S. Appl. No. 29/567,665 dated Mar. 19, 2018.

Final Office Action for U.S. Appl. No. 29/567,666 dated Feb. 26, 2018.

Advisory Action for U.S. Appl. No. 15/177,078 dated Feb. 21, 2018.

Advisory Office Action for U.S. Appl. No. 15/177,091 dated Jan. 19, 2018.

Non Final Office Action for U.S. Appl. No. 15/177,091 dated Mar. 27, 2018.

Final Office Action for U.S. Appl. No. 15/177,091 dated Oct. 5, 2017.

Co-Pending Design U.S. Appl. No. 29/548,144 entitled, "Hand Stamp" to Riegler et al. filed Dec. 10, 2015.

Co-Pending Design U.S. Appl. No. 29/567,664 entitled, "Hand Stamp" to Riegler et al. filed Jun. 10, 2016.

Co-Pending Design U.S. Appl. No. 29/567,665 entitled, "Stamp Pad" to Riegler et al. filed Jun. 10, 2016.

Co-Pending Design U.S. Appl. No. 29/567,666 entitled, "Hand Stamp" to Riegler et al., filed Jun. 10, 2016.

(56) References Cited

OTHER PUBLICATIONS

NPL02—Registered Community Design No. 002716431, registered Community design for hand stamp and pad, Jun. 10, 2015, 86 pages.
NPL03—Written Opinion for PCT/AT2015/050003 dated Sep. 11, 2015. (publication No. WO2015103654).
NPL04—International Search Report for PCT/AT2015/050003 dated Dec. 11, 2015. (publication No. WO2015103654).
NPL05—Registered Community Design No. 002904854, registered Community design for hand stamp and pad, Dec. 10, 2015, 23 pages.
Co-Pending U.S. Appl. No. 15/177,072 entitled, "Stamping Device and Stamping Insert, Especially as a Replacement Part for a Stamping Device" to Scharinger et al., filed Jun. 8, 2016.
Co-Pending U.S. Appl. No. 15/177,078 entitled, "Stamp and Stamping Insert, Especially as a Replacement Part for a Stamp" to Riegler et al., filed Jun. 8, 2016.
Co-Pending U.S. Appl. No. 15/177,078 entitled, "Stamp and Stamping Insert, Especially as a Replacement Part for a Stamp" to Riegler et al., filed Apr. 27, 2020.
Co-Pending U.S. Appl. No. 15/177,091 entitled, "Stamp, an Ink Pad and a Closure Cap" to Sillipp et al., filed Jun. 8, 2016.
Co-Pending U.S. Appl. No. 15/177,100 entitled, "Stamp and Stamping Insert" to Zehetner et al., filed Jun. 8, 2016.
Co-Pending U.S. Appl. No. 15/110,610 entitled, "Processing System for Multiple Differing Workpieces" to Pinot et al., filed Jul. 8, 2016.
Co-Pending U.S. Appl. No. 16/338,585 entitled: "Method for Engraving, Making and/or Inscribing a Workpiece Using a Laser Plotter, and Laser Plotter Herefor" to Hofinger, filed Apr. 1, 2019.
Notice of Allowance for U.S. Appl. No. 15/177,072 dated Jan. 14, 2020.
Notice of Allowance for U.S. Appl. No. 15/177,078 dated Dec. 27, 2019.
Non-Final Office Action for U.S. Appl. No. 16/859,690 dated Jun. 29, 2020.
Non Final Office Action for U.S. Appl. No. 15/177,091 dated Dec. 26, 2019.
Final Office Action for U.S. Appl. No. 15/177,091 dated Apr. 3, 2020.
Advisory Action for U.S. Appl. No. 15/177,091 dated Jul. 17, 2020.
International Preliminary Report on Patentability for PCT/AT2017/060237 dated Apr. 9, 2019. (publication No. WO2018064692).
NIPL06—Amazon. <URL: https://www.amazon.com/dp/B01MQDH576?psc=1.> Nov. 3, 2016. Self-inking stamp.
NPL07—Amazon. <URL: http://a.co/3GHpXYC.> Feb. 12, 2013. Self-inking stamp.
NPL08—Amazon. <URL: https://www.amazon.com/Replacement-Trodat-Printy-I nkinguStamps/dp/BOOFB70JEO/ref=sr_ 1_ 1 ?ie=UTF8&qid=1496770907&sr=8-1 &keywords=Replacement+Ink+Pad.> Feb. 11, 2012. Replacement Ink Pad.
NPL09_Universal Laser Systems, Inc., "The Turnkey Laser Personalization and Identification Program," 2000.
Notice of Allowance for U.S. Appl. No. 29/567,664 dated Jul. 12, 2017.
Non Final Office Action for U.S. Appl. No. 29/567,665 dated Jun. 29, 2017.
Non Final Office Action for U.S. Appl. No. 29/567,666 dated Jun. 30, 2017.
Non Final Office Action for U.S. Appl. No. 15/177,072 dated Mar. 27, 2017.
Non Final Office Action for U.S. Appl. No. 15/177,078 dated Mar. 31, 2017.
Non Final Office Action for U.S. Appl. No. 15/177,091 dated Mar. 31, 2017.
NPL10—Communication for U.S. Appl. No. 29/567,665 dated Jan. 3, 2018.
Final Office Action for U.S. Appl. No. 15/177,072 dated Oct. 11, 2017.
Advisory Action for U.S. Appl. No. 15/177,072 dated Dec. 27, 2017.
Final Office Action for U.S. Appl. No. 15/177,078 dated Oct. 20, 2017.
Notice of Allowance for U.S. Appl. No. 15/177,100 dated Oct. 19, 2017.
Final Office Action for U.S. Appl. No. 15/177,078 dated Jan. 28, 2019.
Advisory Action for U.S. Appl. No. 15/177,078 dated Apr. 18, 2019.
Non Final Office Action for U.S. Appl. No. 15/177,078 dated Aug. 9, 2019.
Non Final Office Action for U.S. Appl. No. 15/177,072 dated Apr. 25, 2019.
NPL13—International Search Report for PCT/AT2017/060146 dated Jan. 15, 2019. (publication No. WO2017210711).
NPL15—Written Opinion for PCT/AT2017/060146 dated Jan. 15, 2019. (publication No. WO2017210711).
NPL14—International Preliminary Report on Patentability for PCT/AT2017/060146 completed Sep. 5, 2018. (publication No. WO2017210711).
NPL11—Written Opinion for PCT/AT2017/060237 dated Mar. 23, 2018. (publication No. WO2018064692).
NPL12—International Search Report for PCT/AT2017/060237 dated Mar. 23, 2018. (publication No. WO2018064692).
Non Final Office Action for U.S. Appl. No. 15/177,091 dated May 2, 2019.
Notice of Allowance for U.S. Appl. No. 29/567,666 dated Dec. 12, 2018.
Final Office Action for U.S. Appl. No. 15/177,091 dated Oct. 4, 2018.
Advisory Action for U.S. Appl. No. 15/177,091 dated Dec. 19, 2018.
Notice of Allowance for U.S. Appl., No. 15/110,610 dated Sep. 25, 2018.
Final Office Action for U.S. Appl. No. 15/177,072 dated Sep. 14, 2018.
Advisory Action for U.S. Appl. No. 15/177,072 dated Nov. 23, 2018.

DRIVE UNIT FOR A BAND GEAR IN AN IMPRESSION UNIT FOR A STAMP

BACKGROUND OF THE INVENTION

1. Field of the Invention

The present disclosure relates to an improved drive unit for a stamp including an impression unit.

2. Description of the Relevant Art

DE 16 54 769 U discloses a drive unit in which the band gear consists of an adjustment wheel and a driver for the conveyor band, wherein the adjustment wheel and the driver are formed from one piece. In addition, a rubber pad is provided on the driver, which is intended to improve the transport of the conveyor band.

In addition, DE 17 96 254 U discloses a drive unit, in which a soft rubber or rubber-like plastic is plugged onto the driver. This friction lining has a surface with a knobbed profile. The knobbed profile is intended to ensure that a corresponding deformation occurs, and that thus reliable transport of the band is ensured.

WO 2006/079129 A1 discloses a type unit, in which the adjustment wheel is formed from a 2C injection-moulded component. This is intended to improve operator comfort upon actuation of the adjustment wheel, as the outer area of the adjustment wheel is formed with a soft rubber. The driver is again commercially formed from a single plastic material.

A disadvantage of the aforementioned prior art is that the rubber pads on the driver brought about significant improvements for a short period of time, but had significant disadvantages in long-term operation, so that the stamp-making industry preferably uses one-part plastic adjustment wheels with drivers made of hard, non-elastic plastic materials. In order to ensure reliable transport of the band, however, some manufacturers use special surfaces, especially with grooves or projections, on the driver, wherein the conveyor band is designed correspondingly here, resulting in more complicated production of the systems.

As a matter of principle, it should be mentioned that in the case of the conveyor band, also referred to simply as the band, a wide variety of negative characters, in particular numbers or letters, are present on a band on the outside, which leave a positive impression during a stamping operation. Before printing onto a medium, in particular paper, cardboard, fabrics, etc., firstly ink is adsorbed onto the characters via an ink cartridge by butting against the same, in order to be able to produce an impression. The user can select the character to be printed by turning the drive wheel or adjustment wheel, respectively, thereby acting via the driver and a so-called bridge in the print area, wherein during the stamping operation the bridge serves as a counterholder for forming a beautiful imprint.

The objective is to create a drive system, in particular a band gear, a drive wheel or adjustment wheel, respectively, and a bridge, in which the above-mentioned disadvantages have been eliminated and reliable transport during long-term operation is ensured.

SUMMARY

In some embodiments, a stamp includes a drive unit in which at least the driver of the band gear is formed from two different materials, in particular from a 2C injection-moulded component. The outer component of the driver butts against the band or conveyor band, respectively. The outer component has a low thickness, preferably of less than 1.5 mm, in particular 0.4 to 0.8 mm.

Here it is advantageous that in long-term operation the very thin pad of the outermost component allows only minimal deformation due to the tension of the conveyor band, so that the stamp equipped with the same can be used over a period of several years (e.g., in particular from 2 to 20 years). For with the systems from the prior art with correspondingly plugged-on rubber bands it was not possible to produce and apply such thin pads. For thick rubber-like pads or linings have the great disadvantage that, due to the pre-tension of the band, the lining is permanently deformed after some time. Thus the pre-tension of the band decreases, so that after some time no further transport of the band is possible when the adjustment wheel or drive wheel, respectively, is actuated. This was recognised in corresponding tests and developments and eliminated by accordingly reducing the layer thickness for the outer layer, which is subject to friction, so that long-term tests have shown that use over a longer period of time is possible. A further advantage of such a conveyor band is that by using two different materials these materials can be adapted to the respective requirements (i.e. the drive wheel is formed with such a material which enables a safe stop for the rotation of the drive wheel and whereas the driver is formed of a material with high frictional resistance which permits safe and slip-free transport of the band). A particular advantage is that a 2C injection moulding of the band gear provides a reliable hold of the outermost layer. This is so that the band gear cannot detach from the driver, as was the case with plugged-on covers, and at the same time the manufacturing costs can be kept low. The 2C pad also enables a maximally thin (e.g., below 1.0 to 1.5 mm), so that a long service life is achieved, as the soft rubber layer cannot be permanently deformed due to the tension of the band, and thus the tension cannot decrease.

In another embodiment, however, the adjustment wheel and the driver are formed as a single part. This reduces the cost of assembling the transport system by reducing the amount of time required. This also eliminates sources of error, such as detachment of the driver from the adjustment wheel, so that reliable operation is made possible.

It is advantageous to have a design in which the 2C components of the driver and the bridge are connected to one another in the mutual contact region in serrated or gear-shaped fashion with notches or the like, wherein there are regions having a low material thickness or thickness, respectively (e.g., less than 1.5 mm, in particular less than 0.5 mm). This ensures that, due to the large transition surface, a reliable connection is created between the two 2C components. At the same time an area is created that is very thin, i.e. has a very low thickness, so that the soft material cannot be deformed in this area. Here, the thickness at the thinnest point of the outer component is preferably formed from soft material lower than 1 mm, preferably 0.5 mm, so that no deformation can occur over the tensioned band. This embodiment also significantly simplifies production as a 2C component, as there are areas where thicker cross-sections are available into which the soft material is injected, enabling simpler production.

In an embodiment, the driver and the bridge have a smooth surface. This simplifies the assembly of the band, as it only needs to be pushed onto the driver and the bridge, whereas in case of protrusions or recesses the band has to be inserted accordingly. A further major disadvantage of such embodiments of special surfaces is that the component tolerances must be as low as possible so that the band can be used correctly, which is not necessary in the case of a smooth surface made of soft material according to embodiments described herein. Furthermore, a very good and high frictional locking connection between band and driver is achieved by a high contact surface, ensuring very good and reliable transport. A surface can therefore be used on the bridge over which the band glides particularly well, so that the required adjustment force is reduced.

However, an embodiment in which the outer component of the driver is made of a soft, preferably elastic material with high frictional properties is also advantageous. This ensures that slippage of the band during turning of the adjustment wheel is prevented with high likelihood. At the same time, the materials between the driver and band can be matched to each other in order to achieve optimum frictional properties.

However, in another embodiment the bridge is also formed from a 2C injection-moulded component, wherein the outer layer or the outer component, respectively, once more is of low thickness (e.g., less than 1.5 mm). This ensures, for example, that the frictional locking connection in the area of the bridge is reduced in order to achieve low resistance for the band upon turning of the drive wheel. For in the case of the bridge, it is advantageous that the frictional properties are as low as possible in order to create the lowest possible movement resistance for the band, so that it can glide over the bridge with as little resistance as possible, whereas high frictional properties on the driver are advantageous for safe transport of the band.

In an advantageous embodiment, the bridge has a surface with low frictional properties and high gliding properties. This ensures that there is as little frictional resistance as possible when the band is transported across the bridge, which increases user-friendliness upon adjustment of the transport system, as the adjustment force is reduced.

In one embodiment it is advantageous that the band gear, in particular the adjustment wheel, is attached to a component, in particular to a text plate carrier of the impression unit or basic elements, via an axle or protrusions formed on the adjustment wheel. This ensures that a simple design can be created, so that manufacturing costs can be reduced. At the same time, such a drive unit or band gear, respectively, can be inserted into any stamp.

In another embodiment, several band gears are provided in parallel, preferably to form a date. This ensures that several adjustment options are available. In particular, the band gears are simply plugged next to each other onto the axle and preferably form the ABU (assembled band unit) with a common bridge. Here, bands of differing widths are used for the day, month and year, wherein the drivers are always matched to the band width. The driver is preferably slightly wider than the width of a band so that a small gap is formed between the band and the adjoining adjustment wheel or basic element, so that the band does not rub against the adjustment wheel or basic element.

However, it is also advantageous to have one or more band gears of a drive unit, in particular the drivers, designed for differing bands with differing diameters. The result is that for narrower bands preferably a larger diameter of the driver is used. Whereby the tension for this band is increased at the same band length, and therefore the same adjustment force is required as for broad bands, which have a higher adjustment force due to the higher friction. It can therefore be said that due to the differing diameters of the drivers of a drive unit, the adjustment force is matched via the size of the diameter in relation to the width of the band to each other, so that preferably the same adjustment force is required for each band.

Furthermore, the objective is achieved by a band gear, in which at least the driver of the band gear is formed from two different materials, in particular from a 2C injection-moulded component. Wherein the outer component butts against the conveyor band and has a low thickness (e.g., of less than 1.5 mm).

The objective of the invention is also solved by a driver alone, in which the driver is formed from two different materials, in particular from a 2C injection-moulded component. Wherein the outer component, which may butt against a band, has a low thickness (e.g., of less than 1.5 mm, in particular 0.4 to 0.8 mm).

However, the objective is also achieved by a bridge in which the bridge is made of two different materials, in particular a 2C injection-moulded component. The outer component, which may butt against a band, has a low thickness (e.g., of less than 1.5 mm, in particular 0.4 to 0.8 mm).

Here it is advantageous that the outer layer is kept as thin as possible, so that no deformation occurs as a result of permanent application of pressure, as a result of which the tension of the bands would decrease, resulting in slippage when the bands are turned or adjusted, respectively. It is only through this implementation as described herein that it is possible for such a system to function perfectly over the planned service life (e.g., of usually more than 10 years).

The objective of systems and methods described herein is achieved by the spare parts or individual parts, respectively, of the driver and the bridge.

However, the objective is also solved by a stamp, in which in the ABU a band gear, comprising at least an adjustment wheel with a driver and a so-called bridge, is provided in the ABU. Wherein a band is fastened over the driver and around the bridge. The band is adjustable over the driver when the adjustment wheel is actuated, and in which at least the driver of the band gear is formed from two different materials (e.g., from a 2C injection-moulded component). The outer component butting against the band has a low thickness (e.g., less than 1.5 mm, in particular 0.4 to 0.8 mm).

Here, too, it is advantageous that the very thin formation of the soft layer, i.e. the outer component of the 2C driver, ensures that no deformations can occur, but that the high frictional properties for the safe further transport of a band are present. Due to the possibility of 2C manufacture, optimal adaptation of the materials to each other can be possible, i.e. the drive wheel, in particular the driver, is produced with an external component that has a very high frictional locking connection with the material of the band, so that slippage during turning is prevented.

Finally, a design in which the bridge in the ABU is formed from two different materials, in particular from a 2C injection-moulded component, is advantageous, wherein the outer component, which may rest against a band, has a low thickness (e.g., less than 1.5 mm, in particular 0.4 to 0.8 mm). Thus it is possible that due to the 2C design optimal adjustment of the characteristics can be made, i.e. that with the bridge good gliding properties and maximally low friction characteristics are needed for the band, so that a 2C construction element with high gliding characteristics is produced.

It is emphasised that the advantages can be combined with each other, so that in order to avoid repetition not all advantages have always been mentioned.

The invention is described hereinafter in the form of exemplary embodiments, wherein attention is drawn to the fact that the invention is not limited to the exemplary embodiments or solutions, respectively, represented and described.

BRIEF DESCRIPTION OF THE DRAWINGS

Advantages of the present invention may become apparent to those skilled in the art with the benefit of the following detailed description of the preferred embodiments and upon reference to the accompanying drawings.

Figure 8:
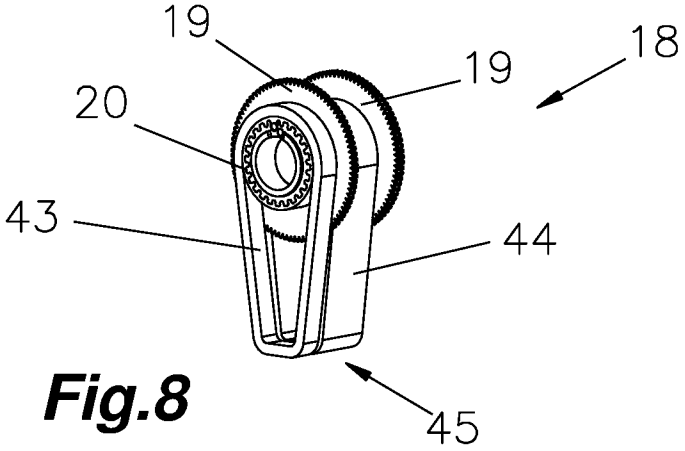
Figure 9:
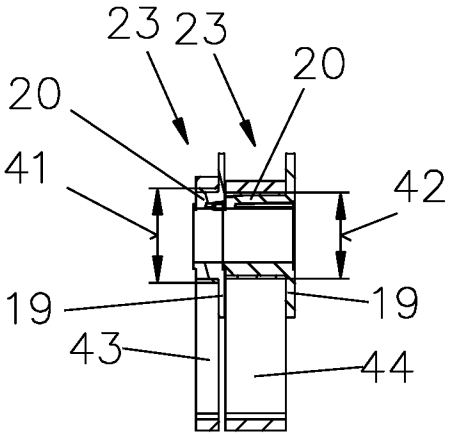
Figure 7:
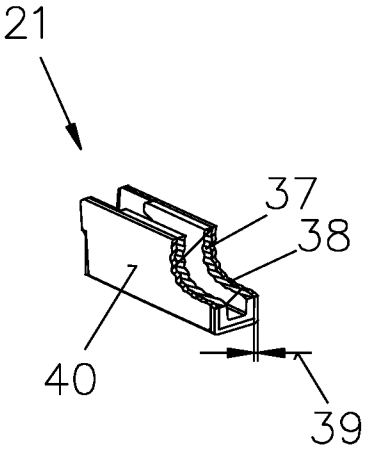

simplified, for illustrative purposes only;

FIG. 7—depicts a schematic illustration of a bridge for the drive unit/ABU; simplified, for illustrative purposes only;

FIG. 8—depicts a schematic illustration of a band gear without bridge; simplified, for illustrative purposes only;

FIG. 9—depicts a sectional view of a band gear according to FIG. 8.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

The headings used herein are for organizational purposes only and are not meant to be used to limit the scope of the description. As used throughout this application, the word "may" is used in a permissive sense (i.e., meaning having the potential to), rather than the mandatory sense (i.e., meaning must). The words "include," "including," and "includes" indicate open-ended relationships and therefore mean including, but not limited to. Similarly, the words "have," "having," and "has" also indicated open-ended relationships, and thus mean having, but not limited to. The terms "first," "second," "third," and so forth as used herein are used as labels for nouns that they precede, and do not imply any type of ordering (e.g., spatial, temporal, logical, etc.) unless such an ordering is otherwise explicitly indicated. Similarly, a "second" feature does not require that a "first" feature be implemented prior to the "second" feature, unless otherwise specified.

Various components may be described as "configured to" perform a task or tasks. In such contexts, "configured to" is a broad recitation generally meaning "having structure that" performs the task or tasks during operation. As such, the component can be configured to perform the task even when the component is not currently performing that task. As such, the component can be configured to perform the task even when the component is not currently on.

Various components may be described as performing a task or tasks, for convenience in the description. Such descriptions should be interpreted as including the phrase "configured to." Reciting a component that is configured to perform one or more tasks is expressly intended not to invoke 35 U.S.C. § 112 paragraph (f), interpretation for that component.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

It is to be understood the present invention is not limited to particular devices, which may, of course, vary. It is also to be understood that the terminology used herein is for the purpose of describing particular embodiments only, and is not intended to be limiting. As used in this specification and the appended claims, the singular forms "a", "an", and "the" include singular and plural referents unless the content clearly dictates otherwise. Thus, for example, reference to "a linker" includes one or more linkers.

DETAILED DESCRIPTION

It should be stated by way of introduction that, in the individual embodiments, the same parts are provided with the same reference numbers or same component designations, respectively, wherein the disclosures contained in the entire description can, by analogy, be transferred mutatis mutandis to identical parts with identical reference numbers or identical component designations, respectively. The position details selected in the description, such as, e.g., top, bottom, lateral, etc., relate to the figure described, and in the event of a change of position, they are to be transferred to the new position by analogy. Individual features or feature combinations from the exemplary embodiments shown and described may also represent independent inventive solutions.

Figure 1:
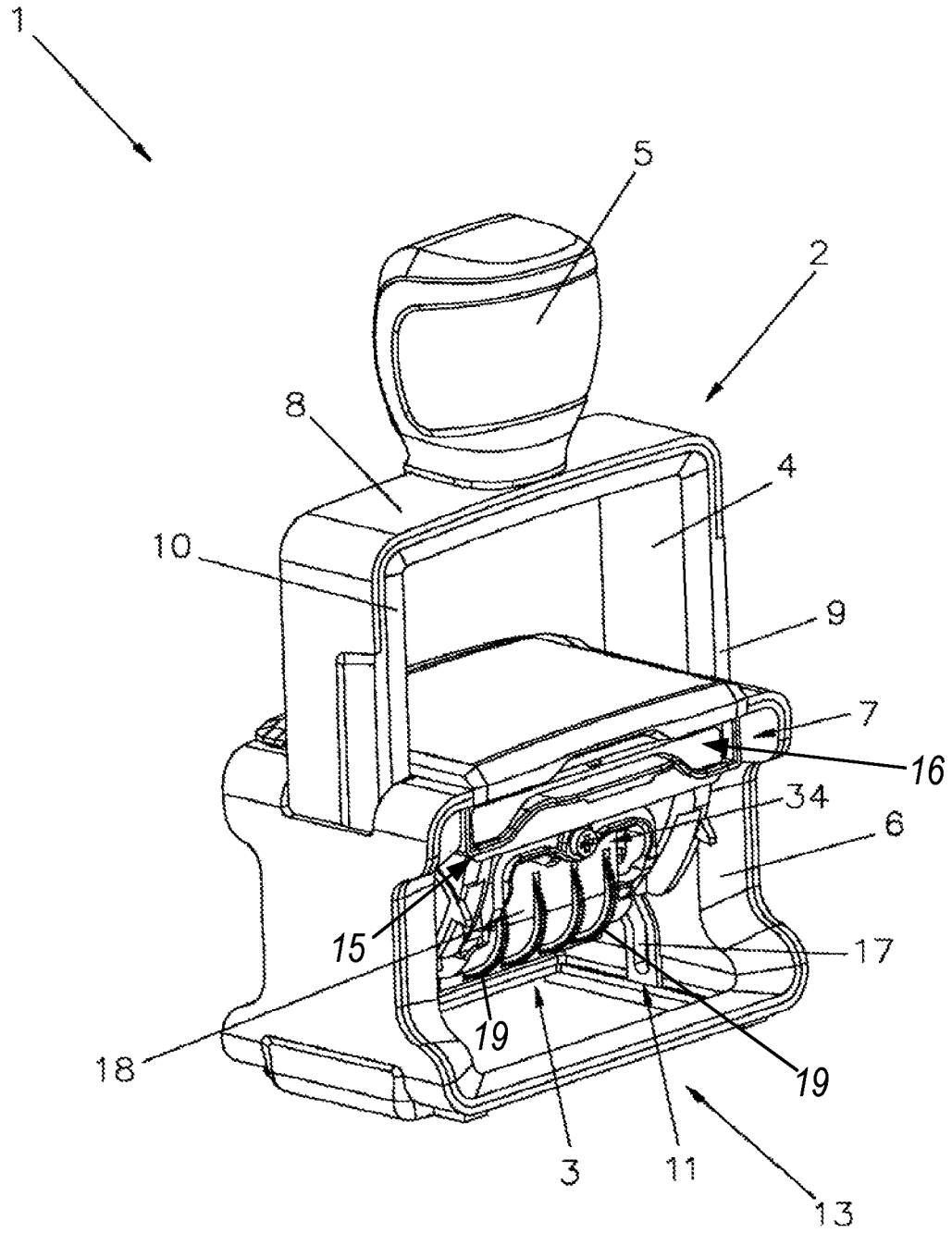
FIG. 1—depicts a schematic illustration of a stamp, particularly a self-inking stamp, in a resting position; simplified, for illustrative purposes only.
Figure 2:
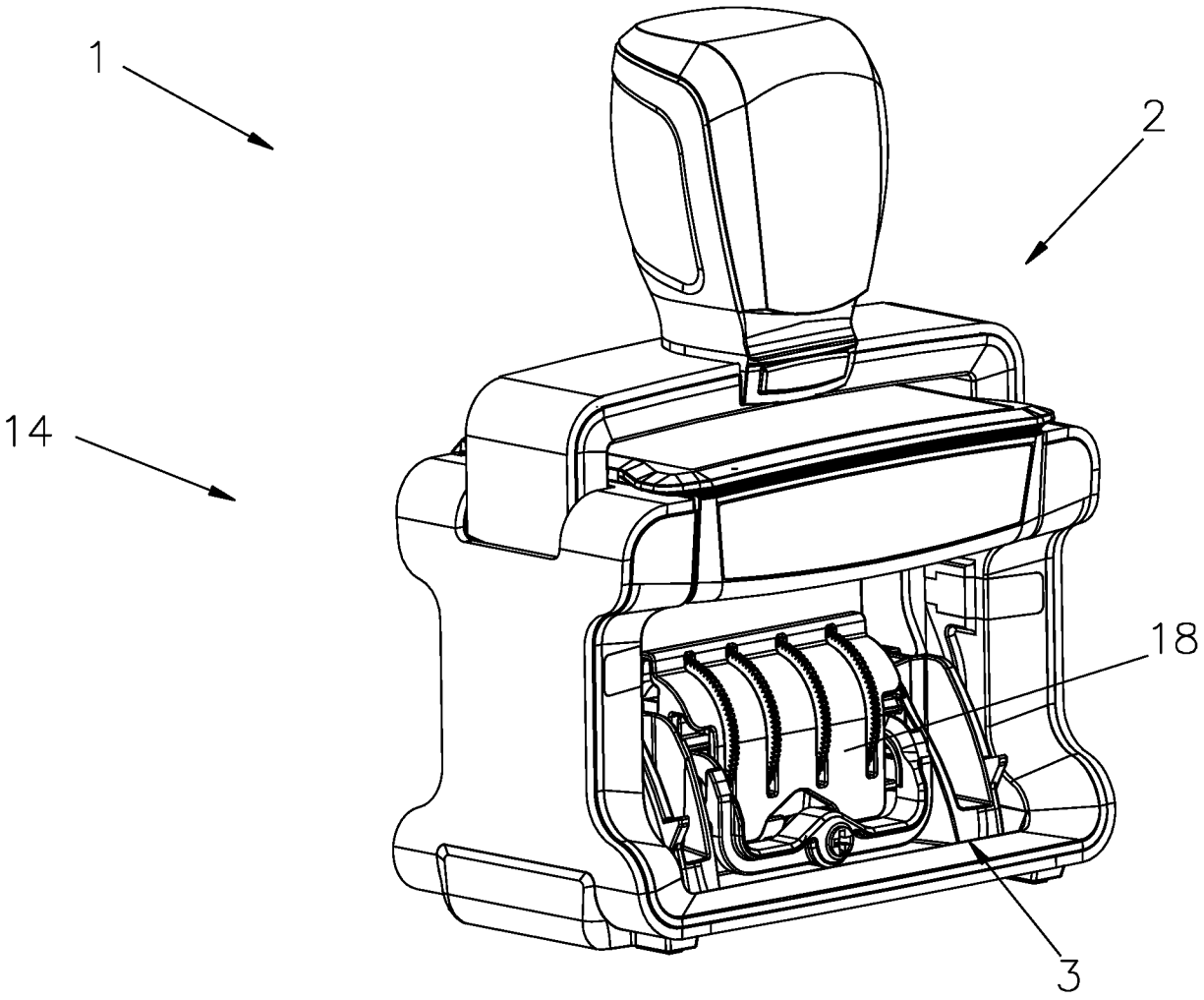
FIG. 2—depicts a schematic illustration of the stamp according to FIG. 1 in a printing or stamping position, respectively; simplified, for illustrative purposes only.

In FIGS. 1 and 2, an exemplary embodiment of a stamp 1, in particular a self-inking stamp 1, is shown, comprising at least a stamping component 2 and one impression unit 3.

The stamping component 2 consists at least of a top part 4 having a handle element 5 and a bottom part 6 with a pad-receiving element 7. The top part 4 is preferably bow-shaped and comprises one longitudinal bar 8 and two lateral elements 9,10, wherein the lateral elements 9,10 are guided in the bottom part 6. The impression unit 3 is connected via an inverting mechanism 11 in the bottom part 6 connected so as to move synchronously to the top part 4 via an axle and a swivel pin (e.g., axle 26 and swivel pin 12, shown in FIG. 4). So that the impression unit 3 in the bottom part 6 can move from a resting position 13, according to FIG. 1, into a printing or stamping position 14, respectively, according to FIG. 2, upon actuation of the top part 4, in particular upon exertion of pressure onto the handle element 5.

Of course, a different design of a stamp 1 is possible, in which the top part 4 is cap-shaped and during a stamping operation receives the bottom part 6 in its interior, as this is the case in plastic self-inking stamps (e.g. the "Printy 4.0" by Trodat described in AT 507 833 A). In the resting position 13, a text plate 15 mounted on the impression unit 3 buts against an ink cartridge 16 soaked with stamp ink in the pad-receiving element 7. Wherein during a stamping operation for producing a stamp impression the impression unit 3 with the text plate 15 is adjustable or adjusted. The impression unit 3 with the text plate 15 is adjustable or adjusted respectively, via the inverting mechanism 11 from the resting position 13 by a rotational movement into the stamping position 14. For example, the impression unit 3 is rotated around the axle 26, for which the inverting mechanism 11 is provided, in which along a predefined slide track 17 rotation of the impression unit 3 is performed. Such inverting mechanisms 11 and rotational movements, respectively, are known from such self-inking stamps 1, so they will not be described in more detail. It is merely pointed out that in the stamp 1 a rigid slide track 17 is shown, but alternatively a movable slide track (not shown) may be employed. Of course, an equivalent construction of the components with a so-called middle spar, as it is known from the prior art, would also be possible, i.e. identical or aliquot, respectively, parts would be used, but an additional middle spar would be inserted in which a spring for return to the resting position 13 is provided. On the stamp 1 shown, the spring (not shown) for return to the resting position 13 is provided in the lateral web 8,9 and bottom part 6.

Usually such a stamp 1 is equipped with an ABU 18 (assembled band unit 18), also known as drive unit 18, which are integrated into the impression unit 3, as shown. Here, this ABU 18 corresponds to a text plate 15 glued to the impression unit 3, wherein for example a date can be set via the ABU 18. It is also possible to use the drive unit 18 without an additional text plate 15.

FIGS. 3 to 9 show the drive unit 18 or ABU 18, respectively, Wherein the drive unit 18 or ABU 18 comprises at least an adjustment wheel 19 with a driver 20 and a bridge 21, a band 22 or conveyor band 22 being fastened and guided over the driver 19 and the bridge 21. Such a unit, consisting of adjustment wheel 19, driver 20, bridge 21 and band 22, forms a band gear 23, wherein preferably several band gears 23 are arranged in parallel next to one another (e.g., four band gears 23 are arranged to form a date, wherein two band gears 23 are present for the day, one band gear 23 for the month and another band gear 23 for the year), so that the bands 22 are provided with various negative symbols or letters, respectively.

Figure 4:
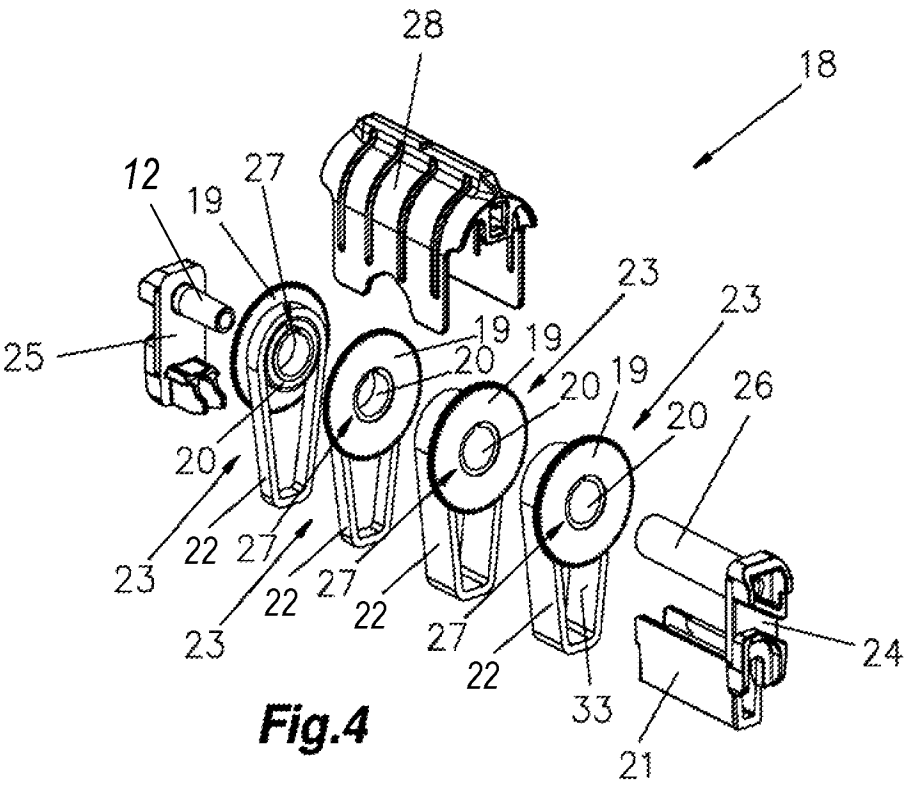
FIG. 4—depicts a an exploded view of the drive unit/ABU according to FIG. 3.
Figure 3:
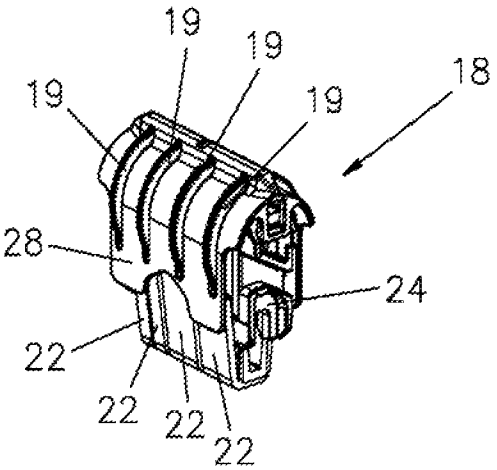
FIG. 3—depicts a schematic illustration of a drive unit/ABU for an impression unit of a stamp; simplified, for illustrative purposes only.

As can be seen from FIG. 4 for an ABU 18 shown for a date, the drive unit 18 has two basic elements 24, 25, which are plugged together to form a basic body. On the basic elements 24, 25 there is on the one hand an axle 26 provided onto which the adjustment wheels 19 with the drivers 20 are plugged, and on the other hand a bridge 21 required for all adjustment wheels 19 and drivers 20, so that the bands 22 from the driver 20 are positioned over the bridge 21. To allow the adjustment wheel 19 and the driver 20 to be plugged on the axle 26, the adjustment wheel 19 and the driver 20 have corresponding openings 27. To protect against soiling, a protective cap 28 can be plugged onto the drive unit 18.

Figure 5:
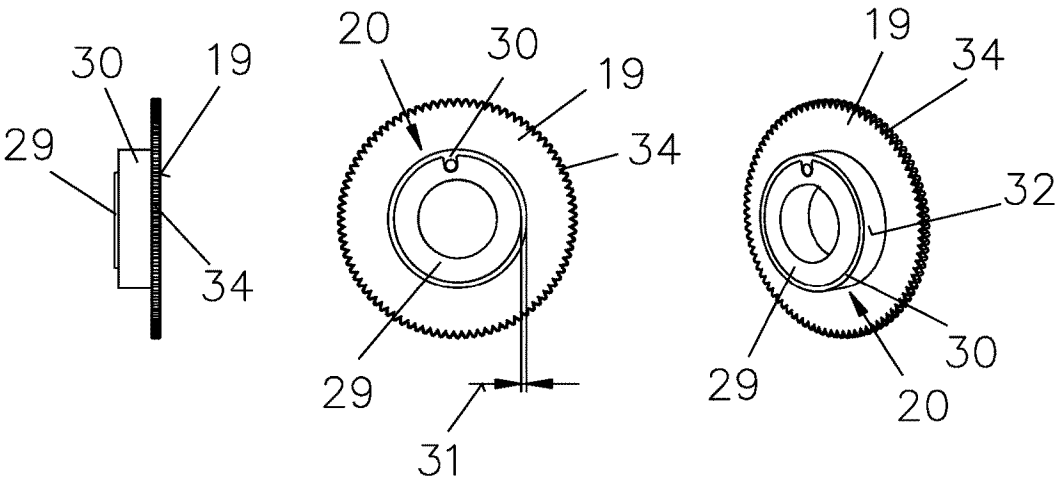
FIG. 5—depicts a schematic illustration of an adjustment wheel with a driver in 2C design; simplified, for illustrative purposes only.
Figure 6:
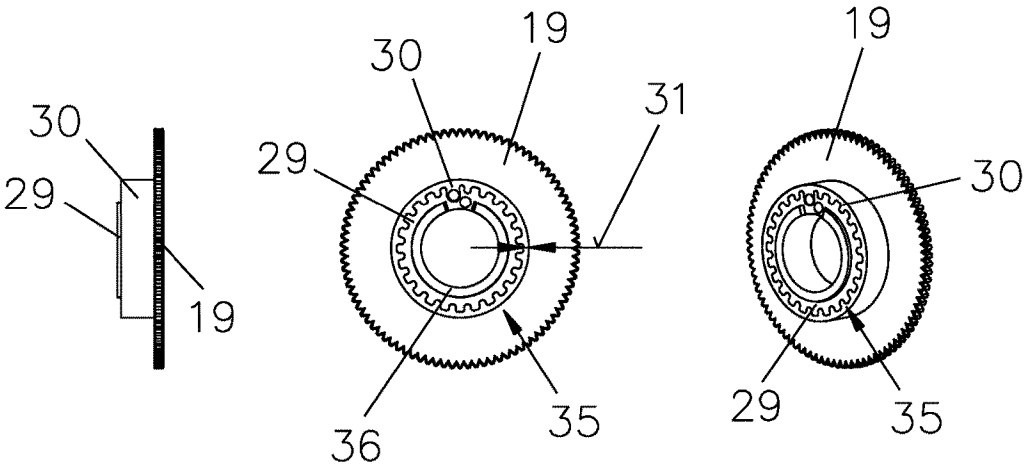
FIG. 6—depicts exemplary embodiments of an adjustment wheel with a driver in 2C design.

FIGS. 5 and 6 show the solution using two exemplary embodiments on a one-part adjustment wheel 19 with the driver 20 (e.g., the adjustment wheel 19 and the driver 20 form a single plastic part). Wherein it is possible, however, that the two parts are two separate components which are fastened to each other in such a way that the driver 20 is rotated together with the adjustment wheel 19 when the latter is rotated. Preferably, however, as shown, the adjustment wheel 19 and driver 20 assembly are formed as a single part.

It is essential here that at least the driver 20 of the band gear 23 is formed from two different materials, in particular from a 2C injection-moulded component 29,30, The outer component 30 butting against the band 22 or conveyor band 22, respectively, has a low thickness 31 (e.g., less than 1.5 mm, in particular 0.4 to 0.8 mm). In the one-part 2C assembly shown, consisting of the adjustment wheel 19, the driver 20, which is formed by the components 29,30, the adjustment wheel 19 and the component 29 are formed from the same material (e.g., ABS or PS or the like). Whereas the component 30 is formed from a soft material with high frictional properties (e.g., from thermoplastic elastomers such as TPE or TPV, or silicone or rubber or the like).

As already mentioned, it is essential that the thickness 31 of component 30 is formed as thin/low as possible, so that no deformation of component 30 is caused by the constant application of force of a tensioned band 22. The essential advantageous properties can be used for a high frictional locking connection by a suitable special material (e.g., in particular with soft properties such as rubber). Thus it is possible that a surface 32 of the outer component 30 is smooth or plane, respectively (i.e., that the driver 20 has a smooth surface 32), wherein the outer component 30 of the driver 20 is made of a soft, preferably elastic material with high frictional properties, so that the tensioning force for the bands 22 can be kept low in order to achieve a comfortable adjustment force. A smooth surface 32 has the advantage that when assembling, i.e. inserting the band 22, it is not necessary to ensure that the band 22 is inserted correctly, as is necessary for systems with grooves and protrusions. Another important advantage is in the manufacturing process, as this also makes it easy to produce the band 22 with a smooth surface 33.

As can be seen furthermore, the adjustment wheel 19 has a serrated surface 34, so that a better hold upon turning of the adjustment wheel 19 is achieved. This prevents the fingers from slipping when adjustment wheel 19 is turned, and more force can be applied to the adjustment wheel 19. It is, of course, also possible to use other embodiments of the surface 34, such as curved, rounded grooves. There would also be the possibility that the outer area of the adjustment wheel 19 would also be formed by a 2C component, since the driver is already produced by a 2C design.

A further development can be seen in FIG. 6, in which the 2C components 29,30 are specially designed in the contact area 35, wherein for this purpose, for example, the contact area 35 is serrated or gear-shaped, or notches are provided for connecting the two components 29, 30. Thus, areas 36 of lower material thicknesses or thicknesses 31, respectively, are preferably lower than 1.5 mm, in particular 0.5 mm, which ensures that no deformations occur on the outer component 30 as a result of the action of the tensioning force of the band 22. By such an embodiment of the contact area 35, a significantly enlarged surface between the two components 29,30 is created, so that a very good connection of the two components 29,30 is achieved. At the same time, however, special areas 36 are provided, which have a thin thickness 31, so that deformation of the outer component 30 is prevented.

It is also possible that in component 29, in the area of the opening 27 for assembly on the axle 26, an insert 36 with good gliding properties can be provided, as shown in FIG. 6. This insert 36 can also be used in other exemplary embodiments, in particular in FIG. 5.

In FIG. 7, the bridge 21 is also shown in 2C design, i.e. two components 37,38, i.e. the bridge 21 is also formed from a 2C injection-moulded component, wherein the outer layer or component, respectively, 38 has a low thickness 39 (e.g., less than 1.5 mm). In contrast to the driver 20, which uses a lining with high frictional properties for good friction-locked transport of the band 22, a lining or a material, respectively, for the outer component 38 with good gliding properties and low frictional adhesion can now be used, so that the band 22 can glide easily over the preferably smooth outer surface 40 of the bridge 21.

Thus it is possible that with a band gear 23 the driver 20 and the bridge 21 are manufactured as 2C components from different material combinations, wherein it is also possible that only one part, i.e. the driver 20 or the bridge 21, is formed as a 2C component. It is essential that the thickness 31 and 39 of the outer components 30, 38 are as thin as possible, so that deformation of the outer components 30 and 38 by the band tension of the band 22 is not possible. If, as is known from the prior art, overly thick outer additional bands are used, the outer additional bands would be deformed over a longer period of time due to the permanent load on the band 22, so that the band tension decreases and the band 22 slips when turning the adjustment wheel 19. Due to this problem, the system known from the prior art has not prevailed on the market, so that production or use in the stamp, respectively, was discontinued.

Furthermore, FIGS. 8 and 9 show an exemplary embodiment in which for the individual bands 22 band gears 23 of different sizes are used, i.e. one or more band gears 23 of a drive unit 18, in particular the driver 20, are designed for the different bands 22 with different diameters 41,42. The bands 22 for the individual drivers 20 preferably have the same length, so that the bands 22 are tensioned differently by the different diameters 41,42. Preferably the diameter 41 is larger for a day band 43 than for a month band or year band 44, so that due to the higher tensioning force of the day band 43 the lower friction forces are compensated with this band 22 and thus all band gears 23 of a drive unit 18 require approximately the same adjustment force. Here it is essential that a flat or straight, respectively, impression surface 45 is created in the area of bridge 22 (not shown) so that high imprint quality is achieved during the stamping operation.

This solution of the different diameters 41,42 of the drivers 20 for adjusting the adjustment force of a band gear 23 is to be applied independently of the 2C design, i.e. this solution can be used for known adjustment wheels with drivers 20 without 2C design as well as for the new solution according to the present invention with 2C design.

It should be noted that, of course, a separate bridge 21 can be provided for each band gear 23.

As a matter of form, it should finally be emphasised that, for better understanding, drawings have in part been represented not to scale and/or enlarged and/or reduced in size.

In addition, individual features or feature combinations from the various exemplary embodiments shown and described can inherently form independent inventive solutions or solutions according to the present invention.

In this patent, certain U.S. patents, U.S. patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

The invention claimed is:

1. A drive unit for a band gear in an impression unit for a stamp, comprising: at least an adjustment wheel with a driver and a bridge, wherein a band is fastened over the driver and around the bridge, such that, when the adjustment wheel is actuated, the band adjusts via the driver;

wherein the driver comprises components that are connected to one another in a mutual contact region in a serrated or gear-shaped manner with notches, and wherein the mutual contact region has areas of lower material thickness which are at most 1.5 mm.

2. The drive unit of claim 1, wherein the adjustment wheel and the driver are formed as a single part.

3. The drive unit of claim 1, wherein the mutual contact region has areas of low material thickness, which are at most 0.5 mm.

4. The drive unit of claim 1, wherein the driver and the bridge have a smooth surface.

5. The drive unit of claim 1, wherein an outer component of the driver is formed from a soft, elastic material with high frictional properties.

6. The drive unit of claim 1, wherein the bridge is formed of a 2C injection-moulded component, wherein again an component has a low thickness of less than 1.5 mm.

7. The drive unit of claim 1, wherein the bridge is formed with a surface having low frictional properties and high gliding properties.

8. The drive unit of claim 1, wherein the adjustment wheel is fastened to a text plate carrier of the impression unit via an axle or extensions formed on the adjustment wheel.

9. The drive unit of claim 1, wherein a plurality of band gears are provided in parallel side by side, to form a date.

10. The drive unit of claim 1, wherein the drive unit includes one or more band gears for which different bands with different diameters are formed.

11. The drive unit of claim 1, wherein at least the driver of the band gear is formed from two different materials comprising at least a 2C injection-moulded component.

12. The drive unit of claim 1, wherein an outer component of the driver butts against the band and has a low thickness of less than 1.5 mm.

* * * * *